US008683648B2

(12) United States Patent
Halter

(10) Patent No.: US 8,683,648 B2
(45) Date of Patent: Apr. 1, 2014

(54) GATE HOLDER

(76) Inventor: Theodore John Halter, Eagle Lake, MN (US)

( * ) Notice: Subject to any disclaimer, the term of this patent is extended or adjusted under 35 U.S.C. 154(b) by 461 days.

(21) Appl. No.: 12/902,775

(22) Filed: Oct. 12, 2010

(65) Prior Publication Data

US 2012/0084941 A1 Apr. 12, 2012

(51) Int. Cl.
*E05F 3/00* (2006.01)

(52) U.S. Cl.
USPC ..... 16/49; 16/82; 256/73; 49/386; 49/394

(58) Field of Classification Search
USPC ..... 16/86.1, 86.2, 49, 66, 82, 84, 85, 16/DIG. 10; 49/381, 383, 386, 394; 256/26, 73; 292/DIG. 19
See application file for complete search history.

(56) References Cited

U.S. PATENT DOCUMENTS

| | | | | | |
|---|---|---|---|---|---|
| 1,966,028 | A | | 7/1934 | Dorris | |
| 2,062,738 | A | * | 12/1936 | Bigler | 49/241 |
| 2,448,953 | A | | 9/1948 | Blackmon | |
| 2,563,894 | A | * | 8/1951 | White | 49/226 |
| 2,783,071 | A | * | 2/1957 | Williams | 292/109 |
| 2,796,279 | A | * | 6/1957 | Schloer | 292/341.17 |
| 2,839,852 | A | * | 6/1958 | Schloer | 160/144 |
| 3,049,827 | A | * | 8/1962 | Rascov | 49/30 |
| 4,194,264 | A | | 3/1980 | Stoffregen | |
| 4,662,111 | A | * | 5/1987 | Romberg | 49/364 |
| 4,782,628 | A | * | 11/1988 | Gaddis | 49/340 |
| 5,036,796 | A | * | 8/1991 | deMuy et al. | 119/481 |
| 5,067,276 | A | | 11/1991 | Brandt | |
| 5,720,132 | A | | 2/1998 | Renner et al. | |
| 6,070,929 | A | * | 6/2000 | Barkley | 296/76 |
| 6,212,827 | B1 | * | 4/2001 | Miller | 49/345 |
| 6,640,387 | B2 | | 11/2003 | Alonso | |
| 6,666,435 | B2 | | 12/2003 | Blosfelds | |
| 6,739,093 | B1 | * | 5/2004 | Holbert | 49/394 |
| 6,764,125 | B2 | * | 7/2004 | Bacon | 296/100.08 |
| 6,981,295 | B2 | | 1/2006 | Duffy | |
| 7,937,806 | B1 | * | 5/2011 | Doyle | 16/82 |
| 2004/0181902 | A1 | * | 9/2004 | Pierce et al. | 16/49 |
| 2010/0127606 | A1 | | 5/2010 | Collene et al. | |

* cited by examiner

*Primary Examiner* — William Miller
(74) *Attorney, Agent, or Firm* — Leffert Jay & Polglaze, P.A.

(57) ABSTRACT

A gate holder is normally in an open position. When pulled down, a return mechanism is compressed and a gate holding portion engages a self-closing gate for a period of time sufficient to allow a user to move through the gate, and which automatically returns to its open position allowing the gate to close without further interaction by the user.

16 Claims, 2 Drawing Sheets

GATE HOLDER

FIELD

The present disclosure relates generally to gates and in particular the present disclosure relates to gate holders to temporarily hold open self-closing gates.

BACKGROUND

Self-closing gates are often used in areas and in places where daily attention to the gate is not required, or is not possible. Such self-closing gates typically use one of a number of designs for closing the gate after it is opened. For example, in a simple solution, widely used, a gate uses a device similar to a continental gate closer, or a simple spring-hinge closing device.

Gates on ranches and the like are often not allowed to be locked, such as gates that are on private property that is adjacent public lands, so that the private land is required to allow public access through the private property to the public land. Often private property has an interest in keeping a fence and a closed gate so that, for example, cattle cannot wander off the land. In order to allow for an automatic closing of a gate without a lock, there is often a chain or other tether that is connected at one end to the gate and at the other end to a post or the like, and there is a weight (oftentimes a tire or cinder block, or simple spring-hinge closing device) connected to the tether, so that when the gate is not latched open, it will automatically close.

Once the gate is open, to move vehicles and the like through the gate often requires the gate to be latched open, especially if there is only one user. If the latch is not released, the gate will not close. Many people who access public land through private gates are courteous and unlatch a gate when they are done using it. However, some do not. In this situation, cattle or other livestock that may be present on the land may escape, and be harmed, or cause other damage.

For the reasons stated above, and for other reasons stated below which will become apparent to those skilled in the art upon reading and understanding the present specification, there is a need in the art for a gate holder that will allow a normally closed gate to return to its position from being opened, without requiring a user to affirmatively unlatch or untether the gate once it is done being used.

DETAILED DESCRIPTION

Figure 1:
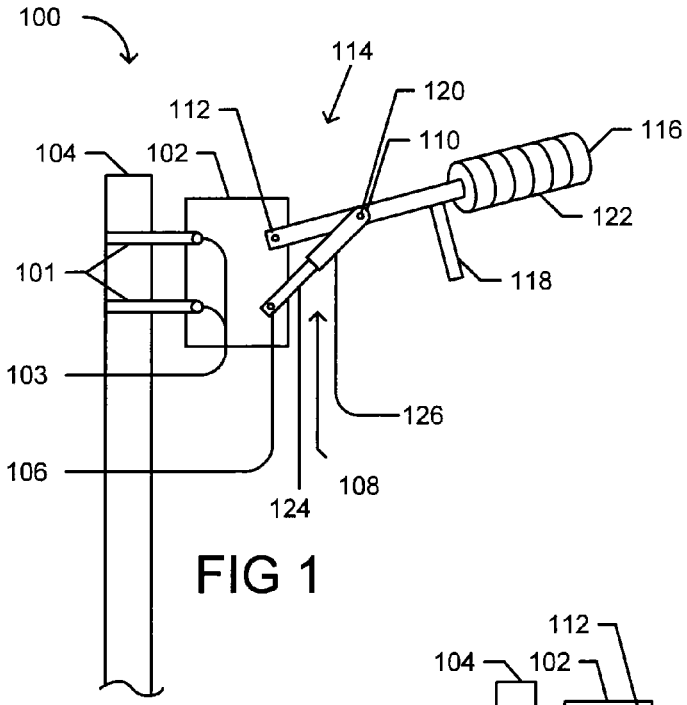
FIG. 1 is a view of an embodiment of the present disclosure in an open position.

In the following detailed description of the embodiments, reference is made to the accompanying drawings that form a part hereof. In the drawings, like numerals describe substantially similar components throughout the several views. These embodiments are described in sufficient detail to enable those skilled in the art to practice the invention. Other embodiments may be utilized and structural and logical changes may be made without departing from the scope of the present invention.

The following detailed description is, therefore, not to be taken in a limiting sense, and the scope of the present disclosure is defined only by the appended claims, along with the full scope of equivalents to which such claims are entitled.

The present invention is directed to those who do not unlatch an open self-closing gate, that has been physically prevented from closing, to allow it to close. In one embodiment, a gate holder includes a mounting plate, a closing arm pivotably connected to the mounting plate, the closing arm having a handle portion and a locking portion, and a return mechanism pivotably connected between the closing arm and the mounting plate. The return mechanism in one embodiment is normally open, and returnably compressible to a compressed position when the closing arm is moved from a first open position to a second closed position.

The gate holder is designed in one embodiment to temporarily hold a gate open, and automatically allow the gate to close after a time period. A more detailed view of one embodiment is shown in an open position in FIG. 1, and a closed, or gate holding, position in FIG. 2. Gate holder 100 in one embodiment comprises a mounting plate 102 for mounting (in any fashion) to a post 104 toward which a gate 150 opens. In one embodiment, mounting plate 102 is attached to post 104 by straps 101 and fasteners 103. Pivotably mounted to the mounting plate 102 are one end 106 of a return mechanism such as a spring-type pressurized shock absorber 108 and one end 112 of a closing arm 114. The closing arm 114 further has a handle portion 122 at end 116 of the closing arm, and a locking extension or mechanism such as a gate latch bar 118. The gate latch bar 118 is engageable with a bar 152 of a gate 150 is shown in greater detail below.

Figure 2:
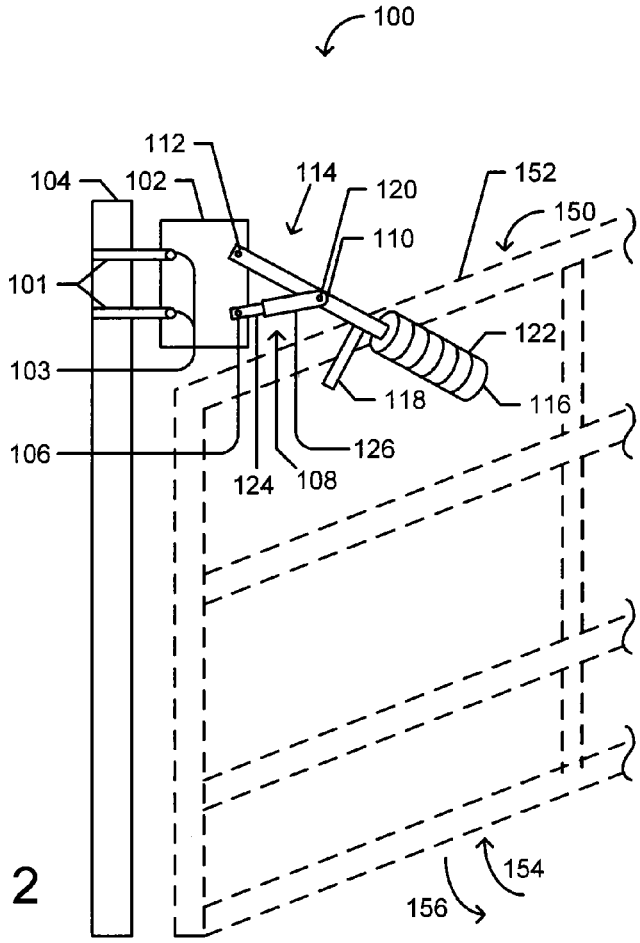
FIG. 2 is a view of the embodiment of FIG. 1 in a closed position.

Referring now also to FIG. 2, the other end 110 of the shock absorber 108 is connected at a point 120 of the closing arm 114 so as to allow gate latch bar 118 to engage a top bar 152 or the like of gate 150 when the handle 116 is pulled down using a handle grip 122 at end 116 of the handle 114.

FIG. 1 shows the gate holder 110 in its normally open position. In this position, the return mechanism 108 is fully extended, with its piston 124 extended from its cylinder 126. Referring again also to FIG. 2, when the handle 122 is used to move gate holder 100 from its first position to its second, compressed position, the piston 124 is compressed into the cylinder in known fashion. From this second position, the piston is gradually expelled from the cylinder to return the shock absorber 108 to its normally open position.

To temporarily hold open a gate or other self-closing structure, the gate or other structure is moved to an open position (as shown in FIG. 2) so that it is near the gate holder. The gate 150 in FIG. 2 moves to an open position in the direction of arrow 154, and is in one embodiment normally biased closed in the direction of arrow 156 by a mechanism such as those described above. The gate holder 100 is locatable at a position so as to allow its use to hold a gate such as gate 150 open. The gate 150 is opened, and a user pulls down on the handle portion 122 of the gate holder 100, compressing the shock absorber 108 to its closed position. The gate latch bar 118 engages the gate top bar (such as bar 152) and holds the gate via the top bar 152, as is shown in FIG. 2.

Once compressed to its closed position, the shock absorber 108 begins to return to its normally open, that is uncompressed, state. This happens gradually, in one embodiment over a period of approximately twenty to thirty seconds. This is sufficient time for a user to engage the gate holder 100 with the gate 150, return to a vehicle, drive through the open gate, and continue without having to exit the vehicle to close the gate. As the shock absorber 108 returns gradually to its normally open position, the gate latch bar 118 eventually disengages from the top bar 152 of the gate 150. The gate 150 is then free to close, typically by a gate closing device such as a chain with a weight, a spring-hinge or the like, as are typically used for self-closing gates. However, any self-closing gate that can be maintained in an open position is amenable to use with the gate holder of the various embodiments.

Further, it should be evident that the size of the gate latch bar 118 can be made different to accommodate different configurations of a gate top bar (such as bar 152) or the like, without departing from the scope of the disclosure.

In operation, the gate 150 is opened to near the post 104. The user grasps end 122 of the handle 114, and pulls downward in the direction of arrow 156 to engage the gate latch bar 118 over the top bar 152 of gate 150. In pulling the handle down in the direction of arrow 158, the user compresses the shock absorber 108. The shock absorber 108 will return to its normally open position over a period of time (typically on the order of 20-30 seconds). As the shock absorber returns to its open position, the gate latch bar 118 eventually disengages the top bar 152 of the gate 150, allowing the gate to close, without any further need for the user to do anything.

Figure 3:
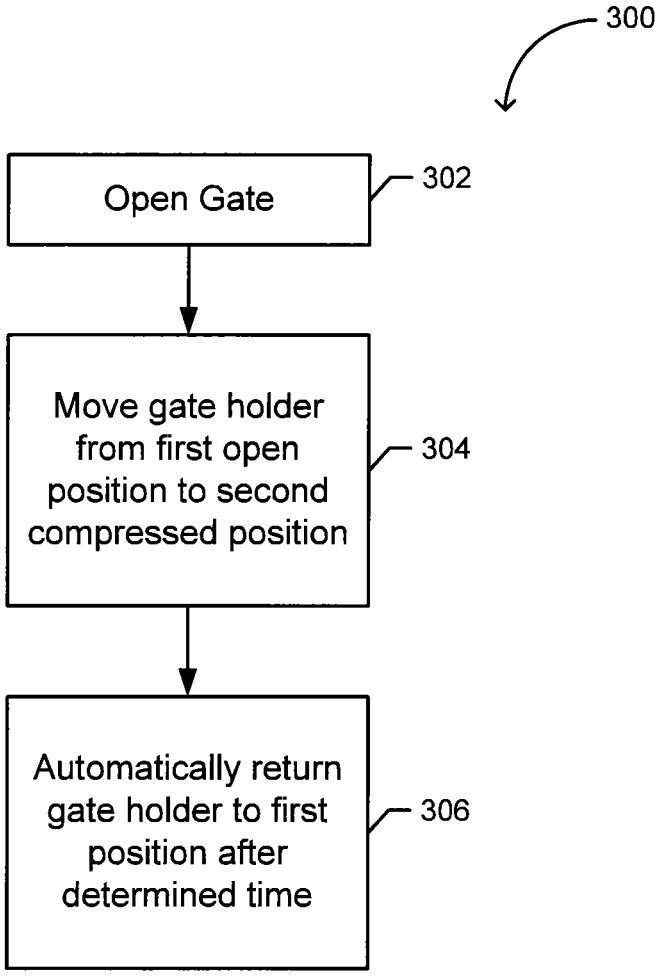
FIG. 3 is a flow chart diagram of a method according to another embodiment of the present disclosure.

A method 300 of operating a gate holder such as those described above is shown in FIG. 3. Method 300 comprises opening the gate in block 302, and moving a gate holder from a first open position to a second closed position in block 304. Moving the gate holder between positions comprises in one embodiment compressing a normally open return mechanism to a compressed position to engage a locking portion of the gate holder with a portion of the gate to hold the gate open. In block 306, the return mechanism returns to its open position over a determined time period.

The time period is adjustable, for example, by adjusting the return mechanism, by adjusting the length of the gate latch bar 118 so that it takes longer for the gate latch bar 118 to disengage from a gate component such as a top bar 152, by adjusting a height of the mounting plate 102 on a post 104 (such as by loosening straps 101 and adjusting the height), by choosing a different return mechanism, or the like. In one embodiment, the time period is approximately twenty to thirty seconds. When the return mechanism returns to its first position, the locking portion releases the gate allowing the gate to close.

It should further be understood that the embodiments of the present disclosure, specifically the concepts of a timed return to an open position after manual levering of a device such as the gate holder described herein, may be used without departing from the scope of the disclosure. Such other embodiments include, by way of example only and not limitation, timed control not requiring electricity or alternate forms of generated power or energy, such as commodities control, timed release devices, timed industrial controls, semi-automated releases. Still further, a plurality of release devices such as those described herein could be chained for use with a system of corrals or other enclosures to move a group of livestock through a path with a single person or the like.

CONCLUSION

A gate holder has been described that includes a return mechanism that normally biases the gate holder open, and keeps the gate holder closed for a period of time until the return mechanism returns from a compressed position holding a gate open to its normally open position allowing the gate to close.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A gate holder, comprising:

a mounting plate;

a closing arm pivotably connected to the mounting plate, the closing arm having a handle portion and a locking portion, the handle and the locking portion in fixed position with respect to each other; and a return mechanism pivotably connected to and between the closing arm and the mounting plate, the return mechanism in an extended open position, and returnably compressible to a compressed position when the closing arm is moved from a first open position to a second closed position, respectively, wherein the closing arm engages a cross member of a gate in the second closed position.

2. The gate holder of claim 1, wherein the compressed position is maintained by the return mechanism for a time period of approximately twenty to thirty seconds.

3. The gate holder of claim 1, wherein the return mechanism is a pressurized shock absorber.

4. The gate holder of claim 1, wherein the handle portion is used to move the closing arm between the first position and the second position.

5. The gate holder of claim 1, wherein the locking portion is engageable with the cross-member of the gate to hold the gate by the locking portion when the closing arm is moved to the second closed position.

6. The gate holder of claim 1, wherein the mounting plate is mountable to a post at a position sufficient to allow the locking portion to engage the open gate when the closing arm is in the second closed position.

7. The gate holder of claim 1, wherein the gate holder is adjustably mountable to a post at a position sufficient to allow the locking portion to engage the open gate when the closing arm is in the second closed position.

8. The gate holder of claim 1, wherein the handle portion and the locking portion are fixed at approximately perpendicular orientations to one another.

9. A method of temporarily holding a gate open, comprising:

opening the gate;

moving a gate holder from a first open position to a second closed position; and a return mechanism returning to an extended open position over a determined time period;

wherein the gate holder comprises:

a mounting plate;

a closing arm pivotably connected to the mounting plate, the closing arm having a handle portion and a locking portion, the handle and the locking portion in fixed position with respect to each other; and the return mechanism pivotably connected to and between the closing arm and the mounting plate, the return mechanism in the extended open position, and returnably compressible to a compressed position when the closing arm is moved from the first open position to the second closed position, respectively, wherein the closing arm engages a cross member of the gate in the second closed position.

10. The method of claim 9, wherein the gate is biased to a normally open position.

11. The method of claim 9, wherein moving comprises compressing the return mechanism to the compressed position to engage the locking portion of the gate holder with the cross member of the gate to hold the gate open.

12. The method of claim 9, wherein the determined time period is approximately twenty to thirty seconds.

13. The method of claim 9, wherein when the return mechanism returns to its extended open position, the locking portion releases the gate allowing the gate to close.

14. The method of claim 9, and further comprising adjusting the determined time period.

15. The method of claim 14, wherein adjusting the determined time period comprises adjusting a height of the gate holder.

16. The method of claim 14, wherein adjusting the determined time period comprises adjusting a length of the locking portion.

* * * * *